US006608247B2

(12) United States Patent
Bryan

(10) Patent No.: US 6,608,247 B2
(45) Date of Patent: Aug. 19, 2003

(54) STRINGED MUSICAL INSTRUMENT WITH SOUNDBOX EXTENSION

(76) Inventor: Harvard Jasper Bryan, 920 Highland Dr., Magnolia, AR (US) 71753

( * ) Notice: Subject to any disclaimer, the term of this patent is extended or adjusted under 35 U.S.C. 154(b) by 0 days.

(21) Appl. No.: 10/000,542

(22) Filed: Oct. 30, 2001

(65) Prior Publication Data

US 2002/0162442 A1 Nov. 7, 2002

Related U.S. Application Data

(60) Provisional application No. 60/288,943, filed on May 7, 2001.

(51) Int. Cl.[7] ..... G10D 3/00
(52) U.S. Cl. ..... 84/291
(58) Field of Search ..... 84/291, 267–269, 84/284, 294, 270–272

(56) References Cited

U.S. PATENT DOCUMENTS 812,049 A * 2/1906 Krueger ..... 84/267
853,686 A * 5/1907 Feather et al. ..... 84/294

* cited by examiner

*Primary Examiner*—Shih-Yung Hsieh

(57) ABSTRACT

A stringed musical instrument having an extended soundbox which enhances the structural integrity and sound quality of the instrument. In a preferred embodiment, the stringed musical instrument with soundbox extension is a mandolin having a main soundbox similar to the soundbox of a conventional mandolin but the soundbox extension of this invention extends forward from the main soundbox toward the head on both sides of the neck between the planes of the back and the top. The soundbox extension is an open channel formed by the top, back, and sides that do not terminate at the front of the main soundbox, as they do on a conventional mandolin, but the extend forward and form an inverted "U" shaped channel. The soundbox extension traverses the neck, fingerboard and strings between the head and the nut of the instrument; as the neck, fingerboard and strings traverse the soundbox extension. The soundbox extension provides enhanced structural integrity by providing means for attaching the neck at both ends, thus eliminating the need for a truss rod through the neck.

4 Claims, 1 Drawing Sheet

STRINGED MUSICAL INSTRUMENT WITH SOUNDBOX EXTENSION

CROSS-REFERENCE TO RELATED APPLICATION

Provisional application, JC872, U.S. PTO, No. 60/288943, May 7, 2001

This invention relates to stringed musical instruments such as mandolins or other stringed musical instruments having soundbox extension which provides enhanced structural integrity and sound quality for the instrument. In a preferred embodiment, the stringed instrument with soundbox extension is a mandolin, characterized by a mandolin body having a main soundbox with a soundbox extension that forms an inverted "U". The "U" shaped soundbox extension is a hollow channel that traverses the neck and fingerboard, between the nut and the head. Likewise, the neck, fingerboard and strings of the mandolin traverse the extension channel. The soundbox extension provides enhanced structural integrity for the neck and fingerboard, as well as enhanced sound, power, and sustain providing increased area for resonation.

STATEMENT REGARDING FEDERALLY SPONSORED RESEARCH AND DEVELOPMENT

Not applicable

REFERENCE TO MICROFICHE APPENDIX

Not applicable

BACKGROUND OF INVENTION

While they vary somewhat in appearance, conventional mandolins and stringed musical instruments in general, are characterized by a body defining a soundbox, with a neck and a mounted fingerboard extending form the body. The new and improved stringed musical instrument of this invention includes an extended soundbox which extends form the main soundbox of the instrument and defines an elongated "U" shaped extension channel, and the neck of the instrument extends from the body across the extended soundbox channel. The extended soundbox both stabilizes the neck on the body of the instrument and projects resonance from the entire length of the main soundbox and the extended soundbox, rather than from just the main soundbox area, as is the case with conventional stringed instruments.

Bearing a slight resemblance to my invention is the Gibson mandolin, known as the Lyre mandolin, which is shown in the publication, *Gibson Guitars* 100 *Years of an American Icon*, page 30, by Walter Carter, Los Angeles General Publishing Group, 1994. That Gibson mandolin is characterized by a pair of curved arms extending from a base, and the neck and fingerboard extend from the base and rests on a solid narrow crosspiece that connects the arms. While it had a distinctive appearance, it was criticized by Roger Siminoff, in the referenced publication as having poor tone, power, and sustain. Roger Seminoff built a Lyre Mandolin in 1975 and even though the Lyre Mandolin has existed for about a hundred years, it has never gone into production.

BRIEF SUMMARY OF THE INVENTION

The mandolin with soundbox extension of the present invention represents an improvement over conventional mandolins and the Lyre Mandolin, in several regards. First, the mandolin with soundbox extension is characterized by enhanced sound quality having excellent tone, power, and sustain, since the extended soundbox increases the area through which the sound of the instrument resonates. The sound difference between the mandolin of this invention and conventional mandolins can be readily detected by applying a stroke to the strings of the mandolin of this invention followed by applying a stroke of equal force to a conventional mandolin.

Second, the tuning of the mandolin of this invention is not affected by temperature and humidity changes to the same extent as is the tuning of conventional mandolins. There is less flexing in the area where tension from the strings is resisted and thus, the mandolin stays tuned better. The pull of the strings is distributed between the neck and the extended soundbox, which reduces the strain of the neck, thus causing tuning of the instrument to be less affected.

Third, the mandolin of this invention can be tuned by plucking the strings and touching the extended soundbox to the player's ear at an area near the head of the mandolin to perceive the true sound, even in a noisy environment or where other instruments are being tuned.

Fourth, unlike conventional mandolins, the mandolin of this invention does not require a strong joint where the neck joins the main body of the soundbox because the neck is further joined to the extended soundbox at its forward most extremity, near the head.

Fifth, since the mandolin neck is supported at both ends, the mandolin of this invention does not require a truss rod extending through the neck to prevent the neck from warping.

Sixth, while the conventional mandolin resonates only in the soundbox area, the mandolin of this invention resonates in the soundbox plus the soundbox extension, thus providing a more powerful, richer and longer-lasting sound.

The primary objective of this invention is to provide a new and improved stringed musical instrument having a soundbox extension which increases the area of resonation enhancing sound quality during playing of the instrument.

The second objective of this invention is to provide a stringed musical instrument having a soundbox extension which enhances the structural integrity of the instrument.

The third objective of this invention is to provide a stringed musical instrument with soundbox extension, in which the soundbox extension attaches to the neck near the head of the instrument, thus eliminating the need for a conventional truss rod extending through the neck of the instrument.

The final objective of this invention is to provide a stringed musical instrument that includes a "U" shaped soundbox extension that is an open channel extending from the main soundbox, a neck traversing the extension channel, a fingerboard provided on the neck, and multiple strings traversing the fingerboard.

These and other objects of the invention are provided in a stringed musical instrument such as a mandolin having a soundbox extension which provides enhanced structural integrity and enhanced resonance, sound quality and sustain during playing of the instrument. While the stringed musical instrument with soundbox extension can be adapted for virtually any type of stringed musical instrument, a preferred embodiment of the instrument is characterized by a mandolin having a soundbox extension that extends from the mandolin main soundbox, defining a generally "U" shaped extension channel traversing the neck, strings and fingerboard. A neck on which is mounted a fingerboard and the neck which terminates in the head extends from the mandolin main soundbox across the extension channel. The soundbox extension provides enhanced structural integrity to the instrument, as well as enhanced sound quality, tone and sustain by increasing the area for sound resonation.

BRIEF DESCRIPTION OF THE DRAWINGS

The invention will be better understood by reference to the accompanying drawings, wherein.

DETAILED DESCRIPTION OF THE INVENTION

Figure 1:
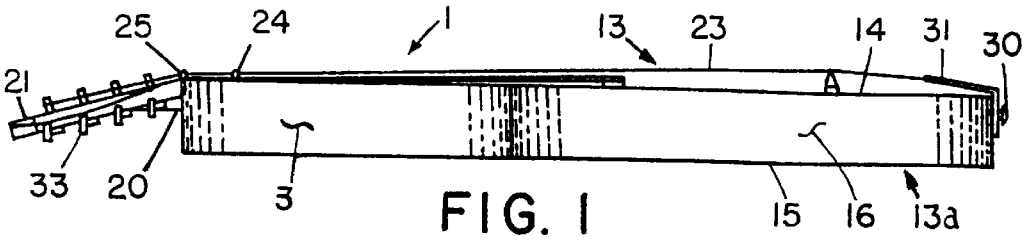
FIG. 1 is a left side view of a preferred embodiment of the stringed musical instrument with soundbox extension of this invention.
Figure 2:
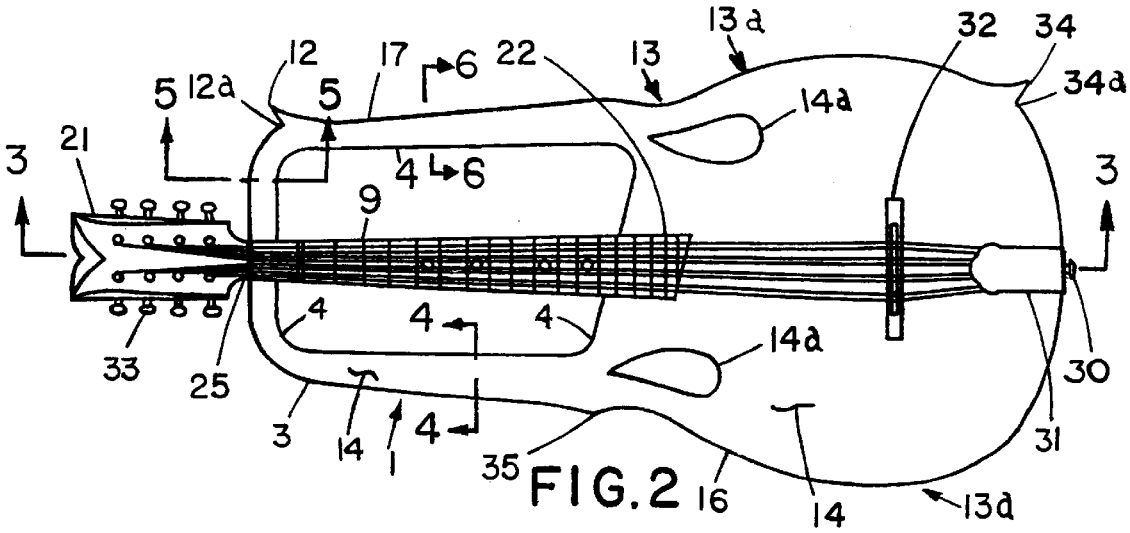
FIG. 2 is a top view of the stringed musical instrument with soundbox extension illustrated in FIG. 1.
Figure 3:
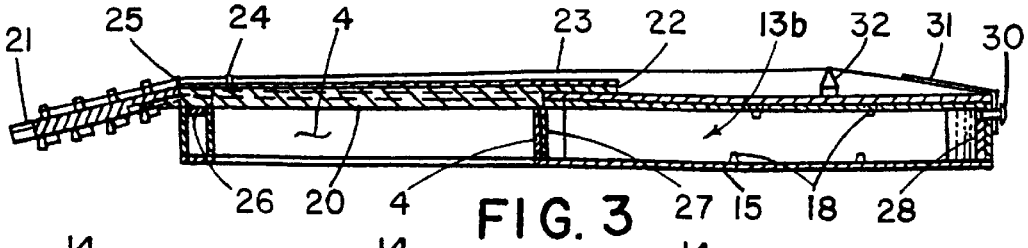
FIG. 3 is a longitudinal sectional view, taken along section lines 3—3 in FIG. 2, of the stringed musical instrument with soundbox extension.
Figure 4:
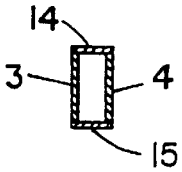
FIG. 4 is a cross-sectional view, taken along section lines 4—4 in FIG. 2, of the stringed musical instrument with soundbox extension.
Figure 6:
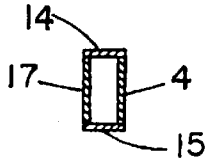
FIG. 6 is a cross-sectional view, taken along section lines 6—6 in FIG. 2, of the stringed musical instrument with soundbox extension.

Referring initially to FIGS. 1–3 of the drawings, the stringed musical instrument with soundbox extension, hereinafter referred to as the stringed musical instrument of this invention, is generally illustrated by reference numeral 13 and is provided with a soundbox extension channel 1 which enhances the sound quality and structural integrity of the stringed musical instrument 13, as hereafter described. While in a preferred embodiment the stringed musical instrument 13 is a mandolin, it is understood that the stringed musical instrument 13 can be any type of finger-actuated stringed musical instrument such as a guitar or ukulele, in non-exclusive particular. As illustrated in FIG. 3 the stringed musical instrument includes a main soundbox 13*a* characterized by a top panel 14 attached to a back panel 15 by means of a left side panel 16 as illustrated in FIGS. 1 and 2, and defining a body interior 13*b*. As further illustrated in FIG. 6 a right side panel 17 further attaches the top panel 14 to the back panel 15. FIG. 3 shows multiple elongated internal cross braces 18 that typically extend transversely along the inside surfaces of the top panel 14 and the back panel 15, respectively in a conventional manner.

As illustrated in FIG. 2, a pair of teardrop-shaped sound holes 14*a* typically extend through the top panel 14 of the instrument body 13, in spaced-apart relationship with each other for purposes of releasing sound.

As shown in FIG. 2, the right side panel strip 17 extends from point 34 to point 12, the left rear side panel strip 16 extends from point 34*a* to point 35 and left front panel strip 3 extends from point 35 to point 12*a*. The inside panel strip 4 extends around the entire inside of the opening in the "U" shaped channel and across the front of the main soundbox. The outside panel stripes 3 and inside panel strip 4 make a smooth radius curvature at the front corners on both sides of the neck.

In FIG. 3, the tail block 28 is provided to reinforce the point of attachment for the tail pin 30 and the attachment of the tail piece 31. The neck piece 20 extends from the head 21, attaches to front block 26, to the middle block 27 and after attaching to the middle block 27 at the forward end of the main soundbox 13*a* and providing a foundation for the fingerboard 22, it is glued to the underside of the top 14 as it extends aft inside of the main soundbox.

In FIGS. 2 & 3, the top panel 14 and the bottom panel 15 are identical in shape and they extend forward from the tail pin 30 to the spacer 25 on the neck. The top 14 and the back 15 extend forward from the main soundbox to form the top and bottom of an extended soundbox.

In FIG. 2, the side 3 and the forward extending portion of side 17 plus the inner side wall 4, completes the "U" shaped channel that creates the extended soundbox.

Figure 5:
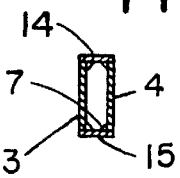
FIG. 5 is a cross-sectional view, taken along section lines 5—5 in FIG. 2, of the stringed musical instrument with soundbox extension.

Conventional type elongated linings 7 are used in all internal corners in the instrument but are not shown except in FIG. 5 for clarity.

In FIGS. 1–3, a fingerboard 22 is mounted on the top surface of the neck 20. A tail piece 31 is mounted on the rear end of the main soundbox body 13*a* by means of screws, not shown. A tail pin 30, seated in tail block 28 is provided to attach a shoulder strap. Multiple strings 23, the rear ends of which are anchored on the tail piece 31 extend across a bridge 32 provided on the surface of the top panel 14, and over multiple frets 9. The strings 23 further extend over a conventional nut 24 and a spacer 25 provided at the forward end of the fingerboard 22, and each string is attached to a corresponding tuning key 33, provided on the head 21.

Referring again to FIG. 2 of the drawings, the stringed musical instrument 13 is played in the same manner as conventional mandolins. Accordingly, the player (not illustrated) grasps the neck 20 with one hand as the player picks the strings 23 with the other hand. Furthermore, since the neck 20 is secured both to the main soundbox and the traversing portion of the extended soundbox, the musical instrument 13 is characterized by enhanced strength and stability.

It will be appreciated by those skilled in the art that the stringed musical instrument with soundbox extension of this invention can be adapted to the design of substantially any type of fretted stringed instrument. The soundbox extension of this invention significantly enhances both the sound quality and structural integrity of the instrument. Moreover, tuning the stringed musical instrument with soundbox extension is not affected by temperature and humidity changes to the same degree as is the case with conventional mandolins. The stabilized neck resists flexing because the pull of the strings is distributed between the neck and extended soundbox. By strumming the strings and touching the extended soundbox to the player's ear near the head of the instrument, the true sound can be discerned, thus the instrument can be tuned in a noisy environment or where other instruments are being tuned. The enhanced stability of the neck, imparted by attachment of the neck to both the instrument body and the soundbox extension as heretofore described, eliminates the need for a truss rod extending through the neck to prevent the neck from warping. While conventional stringed musical instruments resonate only in the area of the soundbox, the stringed musical instrument with soundbox extension resonates both in the main soundbox and in the soundbox extension, thus significantly enhancing the sound, tone, power and sustain of the instrument.

While the preferred embodiments of the invention has been described above, it will be recognized and understood that various modifications can be made in the invention and the appended claims are intended to cover all such modifications which may fall within the spirit and scope of the invention.

What I claim as my invention is:

1. A stringed musical instrument that has a soundbox similar to those employed on conventional stringed musical instruments, but differing with regards to the fact that said instrument includes a top, back and sides that extend forward from said soundbox on both sides of a neck, permitting enough hand clearance around said neck to permit playing the instrument, and creating an open channel that is an extended soundbox in the shape of an inverted U, with said sides making a smooth radius curvature at the front corners on both sides a head at one extremity of said instrument; a nut remote from said head and a neck protruding from said main soundbox, traversing said extended soundbox in the plane between the top and the back, attaching to said extended soundbox, thereby enhancing structural integrity and tone.

2. A stringed musical instrument as set forth in claim 1, wherein an inverted U shaped hollow channel comprises an extended soundbox which defines a closed, rounded channel in direct communication with said soundbox in the plane between the top and the back, traversing and attaching to said neck between said head and said nut.

3. The stringed instrument of claim 1, wherein said extended portion provides an uninterrupted air path in communication with said main portion to thereby provide a smooth passage for the transition of sound resonating from said strings.

4. The stringed musical instrument of claim 1, wherein said soundbox extends forward on both sides of the neck in an inverted U-shaped hollow channel that traverses and attaches to the neck between the head and the nut and provides clearance on each side of the neck to permit playing the instrument in a conventional manner without the hand or arm resting on any enclosure.

* * * * *